US005791266A

United States Patent [19]

Fleming et al.

[11] Patent Number: 5,791,266

[45] Date of Patent: Aug. 11, 1998

[54] COMBUSTION APPARATUS FOR HIGHLY ENERGETIC MATERIALS

[75] Inventors: Jeff L. Fleming, Kingston; Michael P. Barkdoll; Richard Westbrook, both of Knoxville; Chris E. McBride, Lenoir City, all of Tenn.

[73] Assignee: International Technology Corporation, Monroeville, Pa.

[21] Appl. No.: 755,179

[22] Filed: Nov. 25, 1996

[51] Int. Cl.[6] ..... F23G 7/00

[52] U.S. Cl. ..... 110/237; 110/235; 110/248; 110/251; 110/205

[58] Field of Search ..... 110/237, 248, 110/243, 244, 251, 205, 213, 214, 203, 210, 211, 216, 345, 346

[56] References Cited

U.S. PATENT DOCUMENTS

| | | | |
|---|---|---|---|
| 392,984 | 11/1888 | Boehncke et al. . | |
| 508,960 | 11/1893 | Moellenhoff . | |
| 512,106 | 1/1894 | Forrester et al. . | |
| 774,544 | 11/1904 | Weir . | |
| 938,693 | 11/1909 | Osborne . | |
| 2,603,232 | 7/1952 | Keammerer | 137/251 |
| 3,513,870 | 5/1970 | Hirao | 137/251 |
| 3,605,776 | 9/1971 | Fullam | 137/14 |
| 4,023,508 | 5/1977 | Cantrell, Jr. et al. | 110/8 A |
| 4,027,602 | 6/1977 | Mott | 110/7 R |
| 4,323,018 | 4/1982 | Iwasaki | 110/208 |
| 4,516,510 | 5/1985 | Basic, Sr. | 110/346 |
| 4,531,463 | 7/1985 | Kratz et al. | 110/212 |
| 4,961,391 | 10/1990 | Mak et al. | 110/346 |
| 4,969,405 | 11/1990 | Goodrich | 110/210 |
| 5,062,372 | 11/1991 | Ritter | 110/242 |

*Primary Examiner*—Ira S. Lazarus
*Assistant Examiner*—Nhat-Hang H. Lam
*Attorney, Agent, or Firm*—Luedeka, Neely & Graham P.C.

[57] ABSTRACT

The specification describes a system for the thermal treatment of energetic materials which generate a tremendous volume of gaseous products upon combustion. The system includes a containment system which maintains an interface between hot exhaust gas products and a cooler gas, yet allows the relatively slow removal and treatment of the exhaust gas products from the containment system while permitting the inflow of gas into the containment system to replace an equivalent volume of exhaust gas products removed therefrom.

16 Claims, 4 Drawing Sheets

COMBUSTION APPARATUS FOR HIGHLY ENERGETIC MATERIALS

FIELD OF THE INVENTION

The present invention relates to apparatus for the thermal treatment of highly energetic materials, especially waste propellants, explosives and pyrotechnics, and for containment of the exhaust products for subsequent treatment.

BACKGROUND

During the production of rocket fuel, gun propellants, explosive devices and pyrotechnic devices, various waste materials are generated which must be destroyed, typically by combustion, or otherwise disposed of in an environmentally acceptable manner. Combustion of many of these materials occurs extremely rapidly generating large volumes of toxic waste gas products which must be treated before release to the environment. While many of these materials can be burned without detonation, there almost always is a risk that detonation may occur. Because of the potential for transition of the waste materials from controlled burning to uncontrolled, detonation and the tremendous volume of exhaust gas products produced during combustion in a very short time, current practice is to ignite the waste material in an open container so that the exhaust gas products from the combustion are simply exhausted into the atmosphere. Even though the exhaust gas products may contain unburned waste and particulate materials as well as hazardous or toxic components, open container burning of such waste materials has been an acceptable procedure due to the possibility of transition to detonation. However, open burning of these materials is environmentally undesirable and pressure for acceptable alternatives is building.

Accordingly, it is an object of the invention to provide a system suitable for thermally destroying energetic materials which ordinarily will burn yet have the potential for transition from controlled burning to detonation.

Another object of the invention is to provide an apparatus for containment and subsequent treatment of exhaust gases from an energetic waste material, the ignition of which results in a tremendously large volume of exhaust gas products.

Yet another object of the invention is to provide an apparatus which will direct the force of undesired detonation of a waste material away from operating personnel and other equipment so that any damage from detonation is minimized.

Still another object of the invention is to provide an environmentally acceptable system for thermally destroying highly flammable waste material while at the same time providing a means to collect and treat the exhaust gas products.

Other objects and advantages of the invention will be evident from the ensuing description and appended claims.

SUMMARY OF THE INVENTION

With regard to the above and other objects, the present invention provides an apparatus for thermally treating highly energetic materials which produce voluminous gaseous combustion products. The apparatus comprises a combustion chamber in flow communication with a combustion products chamber comprising a gaseous products zone having an upper and a lower portion via a conduit having an open inlet end and an open outlet end wherein the inlet end is connected in fluid flow communication with the products zone and the outlet end is connected in fluid flow communication with the combustion chamber. Gaseous combustion products generated by combustion of material in the combustion chamber flow from the combustion chamber to the products zone through the conduit. The upper portion of the gaseous products zone has a volume sufficient to contain at substantially atmospheric pressure at least substantially all of the gaseous products generated by combustion of materials in the combustion chamber.

An aperture in the combustion products chamber connects the lower portion of the products zone in fluid flow communication with the exterior of the chamber. The outlet end of the conduit is positioned to deliver the gaseous combustion products from the combustion chamber into the upper portion of the products zone so that the gaseous combustion products displace any gas in the products zone downwardly and out through the aperture.

As used herein, the term "combustion" refers to and includes any burning, ignition, combustion, pyrolysis, explosion or thermal oxidation processes whereby all or a portion of the waste material is destroyed and/or reduced to a substantially nonhazardous or non-objectional form.

The term "highly energetic materials" means materials such as waste explosives or the like which will ignite and burn but which have the potential for transitioning between controlled burning and uncontrolled detonation.

A particular advantage of the apparatus of the invention is the ability to substantially contain an energetic material which generates a large volume of exhaust gas products when burned. After or during the burning of the material, the gaseous combustion products contained in the products zone at substantially atmospheric pressure may be treated over a period of time which is relatively long compared to the time the waste is being burned. In most cases, the waste material will be substantially completely burned in less than a few seconds, while the combustion products may take considerably longer to treat. The system according to the invention therefore incorporates both batch and continuous operations in an effective and efficient manner so that release of untreated combustion products to the atmosphere is substantially reduced as compared to current open burning techniques.

The combustion products chamber and the combustion chamber may be in spatially separate locations apart from one another or may be combined in a single multizone chamber. Accordingly, in another aspect, the invention provides an apparatus for thermally treating highly energetic waste materials which produce voluminous gaseous combustion products and for containing the gaseous combustion products produced by burning the waste materials until the combustion products can be treated or disposed of in an environmentally acceptable manner. The apparatus comprises a multizone chamber having a combustion zone and a combustion products zone adjacent the combustion zone and a partition between the combustion zone and the products zone to separate the combustion zone from the products zone. The products zone has a volume which is preferably from about 5,000 to about 25,000 times the volume of waste material to be burned and an upper and a lower portion in fluid flow communication with the combustion zone via a conduit having an open inlet end and an open outlet end. The inlet open end of the conduit is connected in fluid flow communication with the combustion zone and the outlet open end of the conduit is connected in fluid flow communication with the upper portion of the products zone so that gas products in the combustion zone generated from combustion of waste material may flow from the combustion zone to the upper portion of the products zone through the conduit.

An aperture is positioned in the chamber connecting the lower portion of the storage zone in fluid flow communication with the exterior of the chamber. The outlet open end of the conduit is positioned to deliver gaseous products from the combustion zone into the upper portion of the products zone so that during operation gaseous products delivered into the products zone from the combustion zone displace any gas in the products zone downwardly and out through the aperture.

In order to provide a products zone which is adjustable to the volume of gaseous combustion products contained therein, it is preferred that the lower portion of the products zone contain a plurality of regularly dimensioned spaced-apart apertures which are in fluid flow communication with the exterior of the chamber. The apertures provide ingress and egress of air into the products zone upon inflow and outflow of combustion gas products from the products zone. An exhaust gas conduit is provided in the upper portion of the products zone which provides fluid flow communication between the products zone and an exhaust gas treatment system.

BRIEF DESCRIPTION OF THE DRAWINGS

The above and other features and advantages of the invention will now be further described in the following detailed description of a preferred embodiment of the invention considered in conjunction with the drawings in which.

DETAILED DESCRIPTION OF THE PREFERRED EMBODIMENTS

Figure 1:
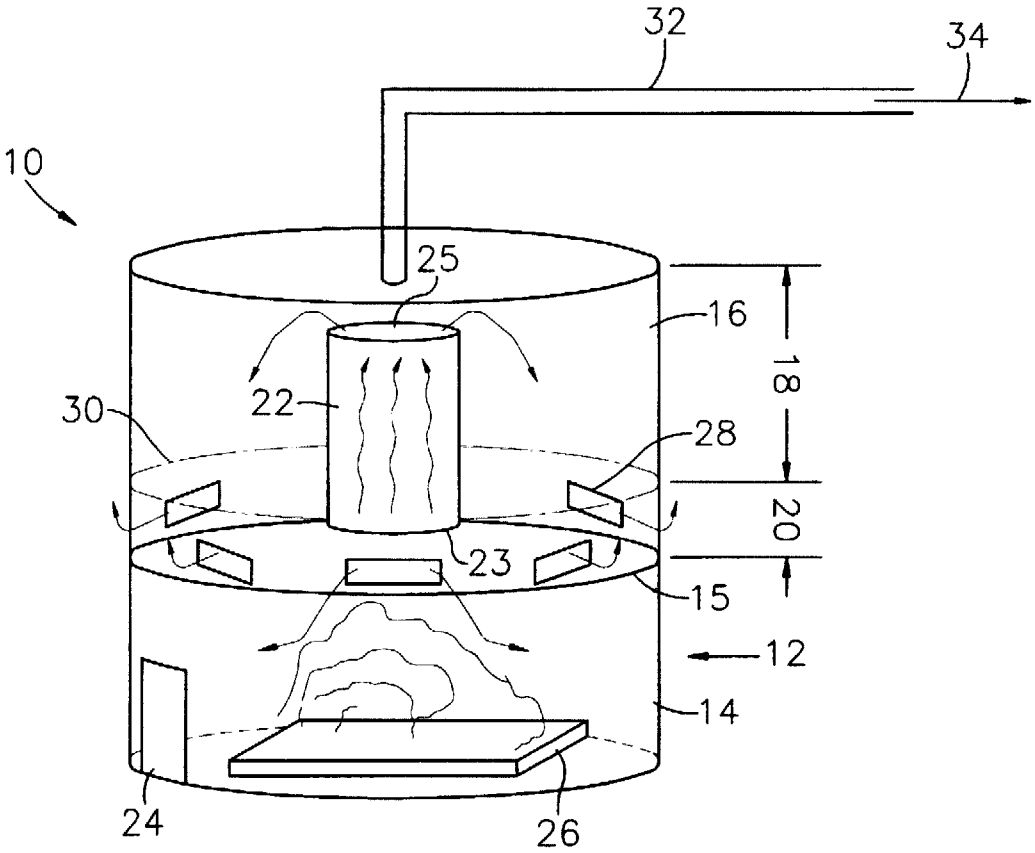
FIG. 1 is a diagrammatic view illustrating various features of a thermal treatment system in accordance with one embodiment of the invention.

With reference now to the drawings in which like reference characters refer to like parts throughout the several views, there is shown in FIG. 1 an apparatus 10, according to the invention, for thermal treatment of energetic material comprising a multizone chamber 12 having an combustion zone 14 and a combustion products zone 16 located above the combustion zone 14 and a partition 15 separating the combustion zone 14 from the products zone 16. The combustion products zone 16 has an upper portion 18 and a lower portion 20.

A conduit 22 having an open inlet end 23 and an open outlet end 25 is connected in fluid flow communication with the combustion zone 14 and the products zone 16. The conduit 22 may be a standpipe which is positioned preferably substantially in the center of the products zone 16. The products zone 16 and conduit 22 preferably have a cylindrical or inverted frusto-conical configuration.

During operation, an energetic material to be treated is placed in the combustion zone 14 through waste material inlet access port 24. The waste material may be placed on a waste material tray or trough 26 if the waste material is in liquid form or otherwise simply positioned on a lower surface of the combustion zone 14. It is preferred that the waste material be positioned near the central area of the combustion zone for the most efficient flow of combustion gas products from the combustion zone 14 to the products zone 16.

Energetic materials which may be burned or destroyed using the system of the invention include energetic wastes from production of military ordnance items, demilitarized ordnance items, outdated or obsolete ordnance or commercial explosives, and the like. The materials may also comprise chemicals used in propellants, explosives, pyrotechnics, waste solvents, sawdust, paper, wood, plastic, metal, water, diesel fuel or other materials contaminated with energetic materials. Most of these materials generate a substantial volume of gaseous combustion products when burned. Containment and treatment of these exhaust gas products by conventional techniques is not only technically difficult, it is very expensive and often less than fully effective.

An important feature of the invention is that the lower portion 20 of products zone 16 contains an aperture 28, preferably a plurality of spaced apart apertures 28 which are in fluid flow communication with the exterior of the multizone chamber 12. Aperture 28 provide ingress and egress of gas into the products zone 16 during passage of combustion exhaust products out of and into the products zone 16, respectively. Accordingly, as the combustion gas products are generated, they displace gas in the lower portion 20 of the products zone 16, which gas is generally cooler and thus denser than the gaseous combustion products. Because of a difference in density between the hot combustion products and the cooler gas in the lower portion 20 there is an interface 30 between the hot combustion products and the cooler gas. It is preferred that the volume of the upper portion 18 of the products zone 16 be adequate to contain substantially all of the combustion products at substantially atmospheric pressure so that the interface 30 remains substantially above aperture 28 to prevent substantially all of the combustion products from escaping the products zone to the atmosphere.

Figure 3:
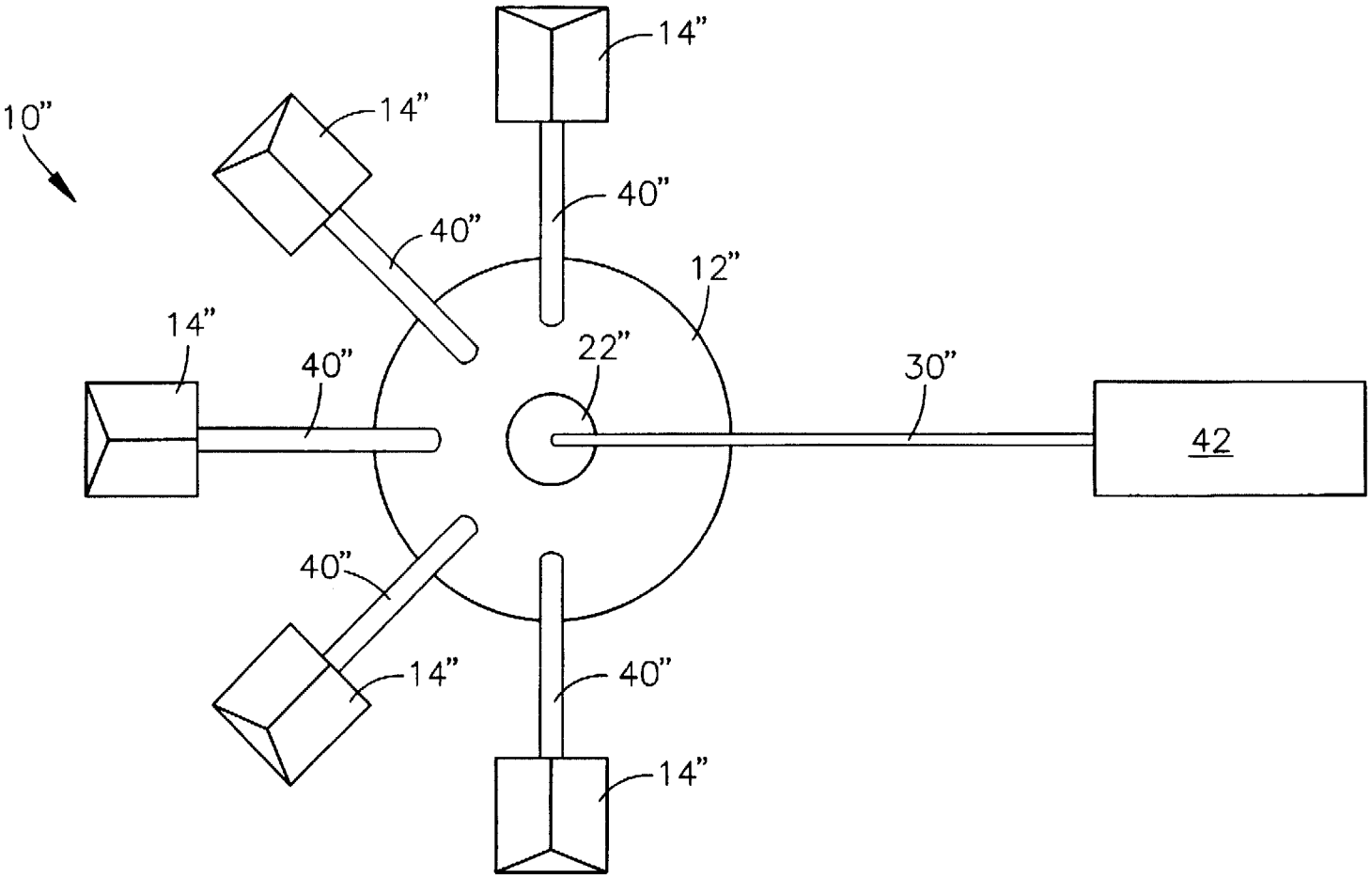
FIG. 3 is a plan view, not to scale, illustrating an orientation of separate combustion chambers relative to a products chamber for use in the FIG. 2 embodiment.

The upper portion 18 of the products zone 16 contains an exhaust gas conduit 32 providing gaseous flow communication between the upper portion and an exhaust gas treatment system 42 (FIG. 3). The exhaust gas treatment system 42 is used to treat the exhaust gas 34 exiting the products zone 16 before discharge of the treated exhaust gas to the atmosphere. The treatment system 42 may include separators such as cyclone separators or bag houses for removal of particulate material from the exhaust gas 34, absorption, adsorption or extraction systems and/or a secondary burner for removal of hazardous or toxic materials from the exhaust gas 34 before it is discharged to the atmosphere.

In operation, as the energetic material in the combustion zone 14 is combusted, vapors and gaseous combustion products resulting from the combustion of the materials travel from the combustion zone 14 through the conduit 22 into the upper portion 18 of the products zone 16 thereby displacing the cooler gas in the lower portion 20 of the products zone 16. During the combustion operation, gas in the lower portion 20 is displaced from the products zone through aperture 28 to the exterior of the chamber 12. On a continuous or semicontinuous basis, the gaseous combustion products in the upper portion 18 are removed at a relatively slow rate through conduit 32 to the treatment system. Accordingly, after completion of the combustion of a batch of energetic materials, gas external to the chamber 12 migrates into the lower portion 20 of the products zone 16 through aperture 28 to displace an equal volume of gaseous combustion products as the combustion products are removed from the upper portion 18 on an essentially continuous basis.

Another important aspect of the invention is the use of conduit 22 having an open inlet end 23 and an open outlet end 25 connected in fluid flow communication with the combustion zone 14 and the upper portion 18 of the products zone 16 respectively. The conduit 22 is preferably a standpipe which has a size and configuration and is positioned in the products zone 16 so that there is essentially no turbulence during the delivery of gases generated by the ignition of energetic materials to the upper portion 18 of the products zone 16, thereby minimizing the intermixing of the gaseous combustion products and cooler gas in the lower portion of the products zone. Because the intermixing of gaseous combustion products and cooler gas in the lower portion 20 of the products zone 16 is minimized, the interfacial layer 30 between the hot combustion gas products and cooler gas will be maintained so that only the cooler gas remains essentially below interface 30 thereby substantially preventing combustion products from exiting the products zone 16 through aperture 28.

For a substantially cylindrical products zone 16 and conduit 22, it is preferred that the conduit have a cross-sectional dimension which is from about 1/5 to about 1/20 that of the cross-sectional dimension of the products zone 16. The conduit 22 may also have a frusto-conical shape wherein the diameters at opposing ends of the conduit are different and each diameter of the conduit may be from about 1/5 to about 1/20 of the diameter of the products zone 16.

Regardless of the particular diameter selected for conduit 22 within the above described dimensions, it is preferred that conduit 22 have a length which is from about 60 to about 90 percent, preferably about 80 percent, of the height of the products zone 16 in order to reduce the intermixing of cooler gas in the lower portion 20 of the products zone 16 with hot exhaust gas products in the upper portion 18 of the products zone 16.

Furthermore, the height of the products zone 16 is preferably selected so that interface 30 always remains essentially above aperture 28 during the combustion of the waste materials thereby preventing escape of combustion products from the chamber 12. While the diameter and height of the products zone 16 depends on how fast the exhaust gas products may be removed from the products zone 16 for treatment and the volume of waste gas generated per volume of energetic material to be destroyed, it is preferred that the products zone have a suitable volume to handle a volumetric increase upon combustion of from about 5,000 to about 25,000 times the volume of energetic material to be destroyed, most preferably from about 6,000 to about 20,000 times the volume of the material to be destroyed.

Figure 2:
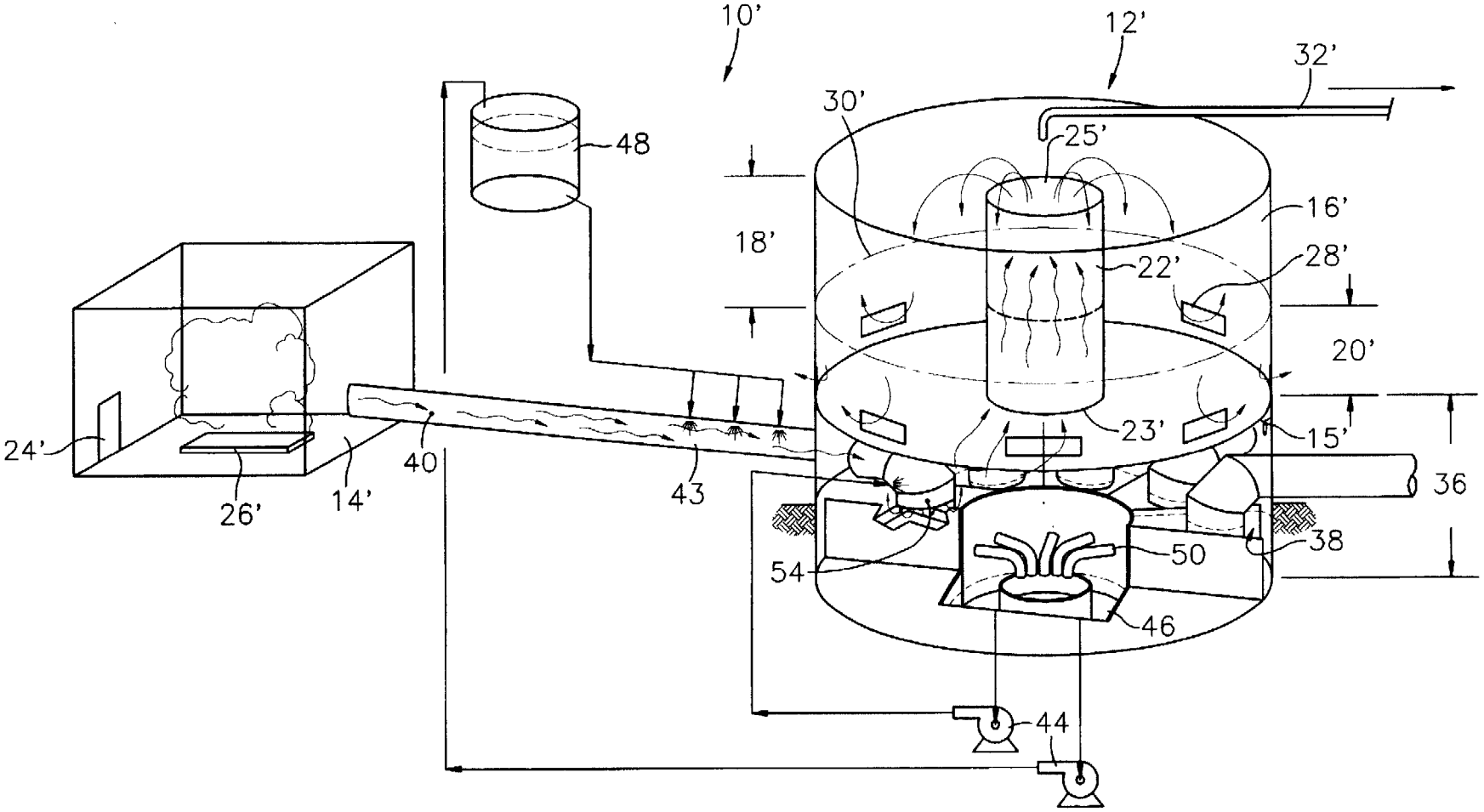
FIG. 2 is a diagrammatic view of another system according to the invention wherein the combustion chamber and products chamber are in spatially separate locations relative to one another.

FIG. 2 illustrates an alternative embodiment of a thermal treatment system 10' of the invention. In this illustration, one or more combustion chambers 14' are located remote from the containment chamber 12'. As in the previous embodiment, the containment chamber 12' has a combustion products storage zone 16' having an upper portion 18' and a lower portion 20'. A partition 15' separating the products zone 16' from a combustion chamber isolation zone 36. A conduit 22' having an open inlet end 23' and an open outlet end 25' is connected in fluid flow communication with the isolation zone 36 and the upper portion 18' of the products zone 16'.

The isolation zone 36 contains combustion chamber isolation devices 38 such as a water valves. Although not preferred, mechanical isolation valves may also be used to block the flow from the combustion chamber 14' through conduit 40 to the isolation zone 36. When a plurality of combustion chambers 14' are used, isolation zone 36 typically contains a plurality of water valves 38 for preventing and permitting exhaust gas products flow from selected combustion chambers 14' into the isolation zone 36 of the containment chamber 12'.

One or more liquid quench sprays 43 may be used to quench the exhaust gas products prior to the exhaust gas products entering the isolation zone 36 of the containment chamber 12' so that high temperature materials of construction are not required for the containment chamber 12' and associated equipment. The quench sprays 43 are preferably located in conduit 40 near the containment chamber 12' so that the quench liquid flows into the lower portion of the chamber 12'. Liquid from the quench sprays may be used to raise the liquid level in the water valve 38 associated with the conduit 40 leading from an operative combustion chamber 14'.

Liquid for the quench sprays 43 may be supplied as recirculated liquid via pumps 44 from a sump area 46 in the isolation valve zone 36 to the sprays 43 and/or to an quench liquid storage vessel 48 which provides liquid to the sprays 43 by gravity feed. In the alternative, the quench liquid for the sprays 43 may be provided by any other suitable means known to those of ordinary skill. Recirculation of liquid from the isolation zone 48 is preferred in order to reduce the amount of liquid which may become contaminated with exhaust gas products and which may require treatment before being discharged from the system.

Each water valve 38 may be individually controlled to permit or prevent flow therethrough from one or more combustion chambers 14' by draining or filling the water valve 38 as desired so that it effectively regulates gas flow through conduit 40. In order to lower the liquid level in the water valve 38, a conduit drain 50 and valve (not shown) may be provided in association with each water valve which may be opened to drain and thus lower the liquid level in the water valve 38 so that the exit 54 of conduit 40 is above the liquid level of water. The water drained from the water valve may be directed into a common sump area 46.

Once the liquid level in the water valve 38 is lowered, the exhaust gas in conduit 40 is in flow communication with the isolation zone 36. By selectively raising and lowering the water level in one or more water valves 38, the flow and thus volume of gas entering the containment chamber 12' may be selectively controlled. In practice, it is preferred to operate one combustion chamber 14' at a time by lowering the liquid level in only the water valve 38 associated with the operative combustion chamber 14'. Upon completion of combustion of the waste material in the combustion chamber, the water valve 38 may be closed by raising the level of liquid in the valve 38, and second combustion chamber associated with second water valve may be operated as described above so that second combustion chamber is in flow communication with the isolation zone 36' of the containment chamber 12'. For lower volumes of gaseous combustion products, several combustion chambers may be operated at one time by lowering the water level in the associated valves.

As the gaseous combustion products flow from the isolation zone 36 through the standpipe 22' into the upper portion 18' of the products zone 16', cooler gas in the lower portion 20' of the products zone 16' is displaced through a plurality of apertures 28' to the atmosphere external to the chamber 12'. During removal of the exhaust gas products from the upper portion 18' of the products zone 16', gas external to the chamber 12' enters the lower portion 20' via apertures 28' and displaces an equivalent volume of exhaust gas products. In this way, substantially all of the combustion products are contained during burning of the waste materials so that the impact on the environment is minimized.

FIG. 3 illustrates a preferred plot plan arrangement for a thermal treatment system 10" according to the invention. The system includes a plurality of combustion chambers 14" radially disposed relative to the containment chamber 12" in spatially separate locations remote from chamber 12". Exhaust gas products from the containment system 12" are conducted by exhaust gas conduit 30" to the treatment system 42 for treatment and removal of any toxic, hazardous and/or particulate material from the exhaust gas products. The treatment system 42 may comprise a scrubber, incinerator, baghouse, electrostatic precipitator, absorber or a combination of two or more of the foregoing treatment systems.

The intra line distance between combustion chambers 14" and between a combustion chamber 14" and the containment chamber 12" is preferably selected so that undesired detonation of waste in one of the combustion chambers will not damage or destroy an adjacent combustion chamber or the containment chamber 12". Criteria for determining the hazards associated with burning energetic waste materials so that the intra line distances may be calculated include the hazard analysis procedures contained in the System Safety Program Requirements of MIL-STD 882C and NAVSEA Operating Procedure No. 5, Vol. 1. For example, the intra line distance between combustion chambers is calculated by the equation $ID=6\ W^{1/3}$ and the intra line distance between a combustion chamber and the containment chamber is determined by the equation $ID=9\ W^{1/3}$, where W is the TNT equivalent weight of the waste material being burned as set forth in AMCP706-177 and ID is the intra line distance in feet. The design of the combustion chamber walls and roof is generally in accordance with well known civil engineering design techniques.

Figure 4:
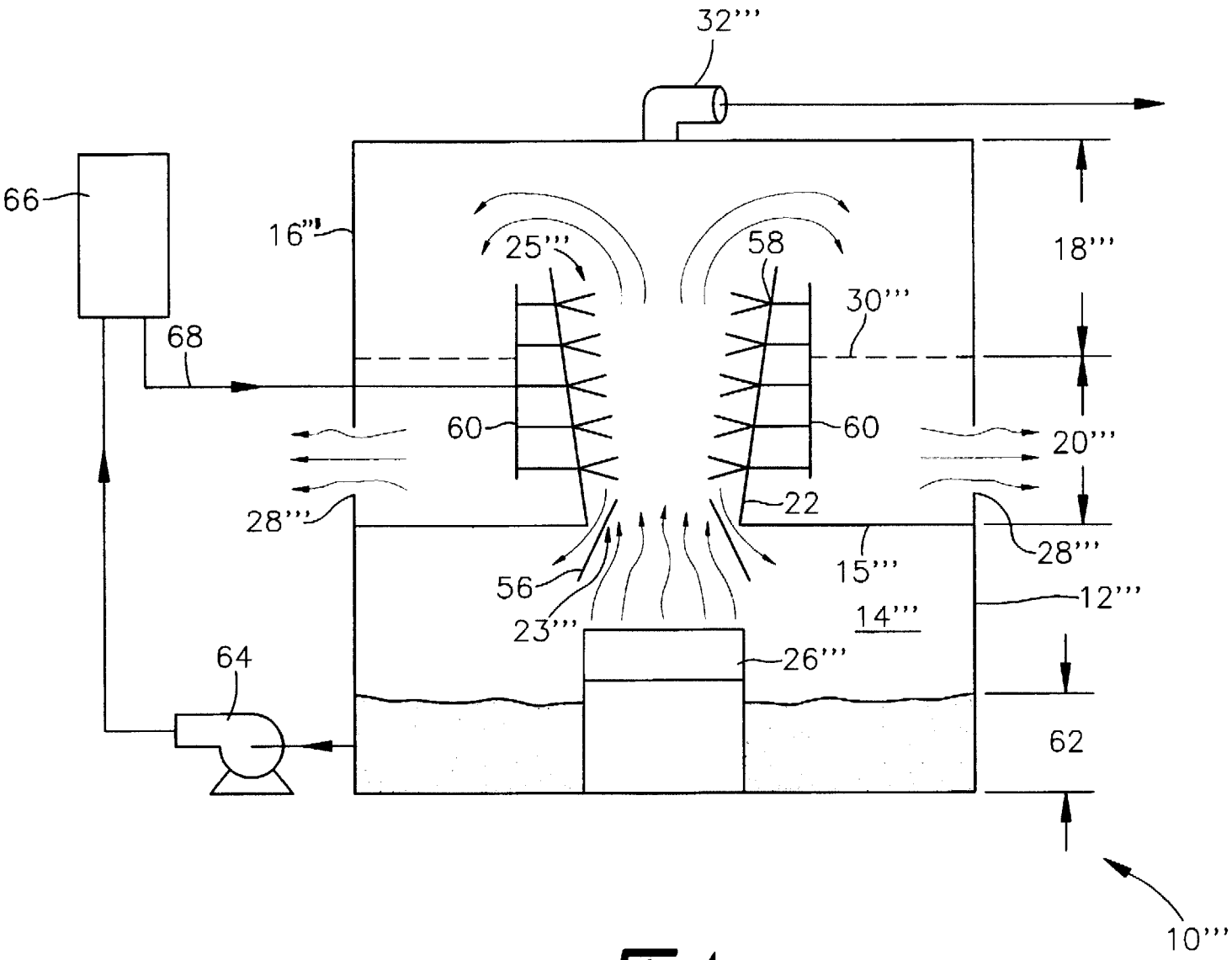
FIG. 4 is a diagrammatic view of a system according to the invention wherein an combustion chamber and a products chamber are contained within a treatment vessel along with quench sprays for quenching the combustion products prior to storage.

FIG. 4 is a diagrammatic illustration of another alternative thermal treatment system 10'" according to another aspect of the invention. In the system 10'" shown in FIG. 4, there is a multizone chamber 12'" having a combustion zone 14'" and a combustion products zone 16'". The products zone 16'" is located above the combustion zone 14'" and is separated therefrom by a partition 15'" therebetween. The products zone 16'" contains an upper portion 18'" and a lower portion 20'". A standpipe 22'" having an open inlet end 23'" in flow communication with the combustion zone 14'" and an open outlet end 25'" in flow communication with the upper portion 18'" is located in the products zone 16'".

During operation of the thermal treatment system 10'" of FIG. 4, waste material to be treated is placed into the combustion zone 14'", preferably on a burn pan 26'" for ignition and burning of the waste. As the waste material is burned, combustion products are directed into the standpipe 22'" by a fume collection device 56. The fume collection device 56 directs the combustion products upward through the standpipe 22'" into the upper portion 18'" of the products zone 16'".

Quench sprays 58 along the flow path of the combustion products flowing through the standpipe 22'" provide cooling of the combustion products before the combustion products enter the products zone 16'". The quench sprays 58 are fed by quench liquid distribution headers 60. The liquid sprayed into the combustion products is directed to the combustion zone 14'" on the outside surface areas of the fume collection device 56 thereby cooling the collection device 56.

As the quench liquid collects in the lower portion 62 of the combustion zone 14'" the liquid is pumped by pump 64 to quench liquid storage vessel 66. Because heat is absorbed by the quench liquid as it contacts the gaseous combustion products, it may be desirable to use a heat exchange device (not shown) for cooling the quench liquid prior to feeding the quench liquid through conduit 68 to the quench sprays 58 or storage vessel 66.

As with the previous embodiments, the combustion products are stored in the products zone 16'" during the waste burning step. Combustion products in the products zone may be treated at a slow rate by transferring the combustion products from products zone 16'" to an exhaust gas treatment system 42 (FIG. 3) while cooler gas external to the products zone 16'" is drawn into the lower portion 20'" of the products zone through apertures 28'" thereby maintaining a constant volume of gaseous material in the products zone 16'". Likewise, as the combustion products are being generated, cooler gas is displaced from the lower portion 20'" of the products zone 16'" through apertures 28'" to the atmosphere external to the products zone.

After the waste burning operation is completed or between waste burning operations, the combustion products in the upper portion 18'" of the products zone 16'" are removed through conduit 32'" to treatment system 42 (FIG. 3). As the combustion products are removed and treated, ambient gas from the atmosphere external to the products zone 16'" enters the lower portion 20'" of the products zone 16'" through apertures 28'" so that an interface 30'" is maintained between the hotter combustion gas products in the upper portion 18'" and the cooler gas in the lower portion 20'" of the products zone 16'".

Because the above described systems contain substantially all of the combustion products generated during the burning of energetic waste materials, there are significant advantages to the use of the apparatus of the present invention which provides a system for suitably treating energetic waste materials without adversely affecting the environment.

Having described and illustrated preferred embodiments of the invention, it will be appreciated that various modifications, rearrangements and substitutions made to the invention by those of ordinary skill are within the spirit and scope of the appended claims.

What is claimed is:

1. An apparatus for thermally treating highly energetic materials which produce voluminous gaseous combustion products, the apparatus comprising:

a combustion chamber in flow communication with a combustion products chamber containing a gaseous products zone having an upper portion and a lower portion via a conduit having an open inlet end and an open outlet end wherein the outlet end is connected in fluid flow communication with the products zone and the inlet end is connected in fluid flow communication with the combustion chamber so that gaseous combustion products generated by combustion of material in the combustion chamber may flow from the combustion chamber to the products zone through the conduit, wherein the upper portion of the gaseous products zone has a volume sufficient to contain at substantially atmospheric pressure at least substantially all of the gaseous combustion products; and an aperture in the combustion products chamber connecting the lower portion of the products zone in fluid flow communication with the exterior of the chamber, wherein the outlet end of the conduit is positioned to deliver the gaseous combustion products from the combustion chamber into the upper portion of the products zone so that the gaseous combustion products displace any gas in the products zone downwardly and out through the aperture.

2. The apparatus of claim 1 wherein said products zone has a volume which is from about 5,000 to about 25,000 times the volume of energetic material to be burned.

3. The apparatus of claim 1 wherein the conduit is a standpipe having a cross-sectional dimension which is from about 1/5 to about 1/20 that of the cross-sectional dimension of the products zone.

4. The apparatus of claim 1 wherein the volume of the upper portion of the products zone is sufficient to contain substantially all of the gaseous combustion products above the aperture.

5. The apparatus of claim 1 wherein the products zone is a cylindrical chamber.

6. The apparatus of claim 5 wherein the conduit is a cylindrical conduit having a length which is from about 60 to about 90 percent of the height of the products zone.

7. The apparatus of claim 1 wherein the conduit is a cylindrical conduit having a length which is about 80 percent of the height of the products zone.

8. The apparatus of claim 1 wherein the aperture comprises a plurality of spaced apart apertures.

9. An apparatus for thermally treating energetic materials which produce gaseous combustion products and for containing the gaseous combustion products produced by burning the waste materials until the combustion products can be treated or disposed of in an environmentally acceptable manner, the apparatus comprising:

a multizone chamber having a combustion zone and a combustion products zone adjacent the combustion zone and a partition therebetween to separate the combustion zone from the products zone, the products zone containing gas and having an upper portion and a lower portion in fluid flow communication with one another and a volume which is from about 5,000 to about 25,000 times the volume of waste material to be burned;

a conduit having an open inlet end and an open outlet end said inlet end connected in fluid flow communication with said combustion zone and said outlet end connected in fluid flow communication with said upper portion so that hot gas products in said combustion zone generated from combustion of waste material may flow from said combustion zone to said upper portion of said products zone through said conduit; and an aperture in said chamber connecting said lower portion of said products zone in fluid flow communication with the exterior of the chamber, wherein said outlet end of said conduit is positioned to deliver the hot gas products into the upper portion of said products zone from said combustion zone so that the hot gas products displace gas in said products zone downwardly and out through said aperture.

10. The apparatus of claim 9 wherein the products zone has a volume which is more than about 6,000 times and less than about 20,000 times the volume of waste material being combusted.

11. The apparatus of claim 9 wherein the conduit is a standpipe having a cross-sectional dimension which is from about 1/5 to about 1/20 that of the cross-sectional dimension of the products zone.

12. The apparatus of claim 9 wherein the volume of the upper portion of the products zone is sufficient to contain substantially all of the gaseous combustion products above the aperture.

13. The apparatus of claim 9 wherein the products zone is a cylindrical chamber.

14. The apparatus of claim 13 wherein the conduit is a cylindrical conduit having a length which is from about 60 to about 90 percent of the height of the products zone.

15. The apparatus of claim 9 wherein the conduit is a cylindrical conduit having a length which is about 80 percent of the height of the products zone.

16. The apparatus of claim 9 wherein the aperture comprises a plurality of spaced apart apertures.

* * * * *

UNITED STATES PATENT AND TRADEMARK OFFICE

CERTIFICATE OF CORRECTION

PATENT NO : 5,791,266

DATED : August 11, 1998

INVENTOR(S) : Jeff L. Fleming, et. al.

It is certified that error appears in the above-identified patent and that said Letters Patent is hereby corrected as shown below:

Figure 4, delete "22" and insert --22'"--.

Column 1, Line 66, after "end wherein the" delete "inlet" and insert --outlet--.

Column 2, Line 68, after "zone and the" delete "outlet" and insert --inlet--.

Column 6, Line 35, after "the isolation zone" delete "48" and insert --36--.

Signed and Sealed this

Fifth Day of January, 1999

*Attest:*

*Attesting Officer*

*Acting Commissioner of Patents and Trademarks*